US010392783B2

(12) United States Patent
Nishide et al.

(10) Patent No.: US 10,392,783 B2
(45) Date of Patent: Aug. 27, 2019

(54) CYLINDER DEVICE

(71) Applicant: Hitachi Construction Machinery Tierra Co., Ltd., Koka-shi, Shiga (JP)

(72) Inventors: Takashi Nishide, Koka (JP); Takeshi Kise, Koka (JP)

(73) Assignee: Hitachi Construction Machinery Tierra Co., Ltd, Koka-shi (JP)

( * ) Notice: Subject to any disclaimer, the term of this patent is extended or adjusted under 35 U.S.C. 154(b) by 15 days.

(21) Appl. No.: 15/555,149

(22) PCT Filed: Feb. 19, 2016

(86) PCT No.: PCT/JP2016/054841
§ 371 (c)(1),
(2) Date: Sep. 1, 2017

(87) PCT Pub. No.: WO2017/043100
PCT Pub. Date: Mar. 16, 2017

(65) Prior Publication Data

US 2018/0044892 A1 Feb. 15, 2018

(30) Foreign Application Priority Data

Sep. 11, 2015 (JP) ..... 2015-179382

(51) Int. Cl.
*E02F 9/24* (2006.01)
*E02F 3/42* (2006.01)
(Continued)

(52) U.S. Cl.
CPC ..... *E02F 9/24* (2013.01); *E02F 3/425* (2013.01); *E02F 9/2271* (2013.01);
(Continued)

(58) Field of Classification Search
CPC ..... E02F 9/24; E02F 3/425; F15B 15/1457; F15B 15/1428; F15B 15/1423
See application file for complete search history.

(56) References Cited

U.S. PATENT DOCUMENTS

2008/0061484 A1 3/2008 Seino et al.

FOREIGN PATENT DOCUMENTS

JP 50-30193 U 4/1975
JP 5-12708 U 2/1993
(Continued)

OTHER PUBLICATIONS

International Search Report (PCT/ISA/220 & PCT/ISA/210) issued in PCT Application No. PCT/JP2016/054841 dated May 10, 2016 with English translation (seven pages).
(Continued)

*Primary Examiner* — Abiy Teka
(74) *Attorney, Agent, or Firm* — Crowell & Moring LLP

(57) ABSTRACT

A bucket cylinder includes a cylindrical tube, a rod having a cylindrical boss part mounted to a protruding end side of the rod, and a protective cover having one side supported by a cover guide provided on the tube, while the other side is mounted on the boss part. A protective protrusion protruding outward in a radial direction of the boss part and protecting the boss part and the protective cover is provided on the boss part. The protective cover is formed having a plate shape by a material having elasticity, and the protective cover includes a plate part for protecting the rod between the cover guide and the boss part and a winding part formed so as to be wound around an outer periphery of the boss part from a distal end side of the plate part. A protective protrusion engaging hole into which the protective protrusion is engaged is provided in the winding part at a position corresponding to the protective protrusion.

4 Claims, 8 Drawing Sheets

(51) Int. Cl.

| | |
|---|---|
| ***E02F 9/22*** | (2006.01) |
| ***F15B 15/14*** | (2006.01) |
| *E02F 3/96* | (2006.01) |

(52) U.S. Cl.
CPC ..... *F15B 15/1423* (2013.01); *F15B 15/1428* (2013.01); *F15B 15/1457* (2013.01); *E02F 3/964* (2013.01)

(56) References Cited

FOREIGN PATENT DOCUMENTS

| | | | | | |
|---|---|---|---|---|---|
| JP | 2006-16854 | A | | 1/2006 | |
| JP | 2007-107314 | A | | 4/2007 | |
| JP | 2007107314 | A | * | 4/2007 | ..... E02F 9/2271 |
| JP | 2013-100674 | A | | 5/2013 | |

OTHER PUBLICATIONS

Japanese-language Written Opinion (PCT/ISA/237) issued in PCT Application No. PCT/JP2016/054841 dated May 10, 2016 (four pages).

* cited by examiner

CYLINDER DEVICE

TECHNICAL FIELD

The present invention relates to a cylinder device suitably used for a working mechanism of a construction machine such as a hydraulic excavator, a wheel loader and the like.

BACKGROUND ART

A hydraulic excavator as a typical example of the construction machine is generally constituted by including an automotive lower traveling structure, an upper revolving structure rotatably mounted on the lower traveling structure through a revolving device, and a working mechanism mounted on a front part of the upper revolving structure, capable of moving upward/downward. The hydraulic excavator is to perform an excavating work of earth and sand and the like by using the working mechanism while revolving the upper revolving structure.

The working mechanism of the hydraulic excavator is constituted by including a boom provided on the upper revolving structure, capable of moving upward/downward, an arm provided rotatably on a distal end side of the boom, and a bucket provided rotatably on a distal end side of the arm. The boom, the arm, and the bucket are driven by a cylinder device constituted by a hydraulic cylinder and the like, respectively.

The cylinder device is constituted by including a tube having a lengthy cylindrical shape in which one side in a length direction is closed as a bottom part, while the other side is a rod guide, a rod having one side mounted to a piston in the tube and the other side protruding capable of extension/contraction from the rod guide side and having a cylindrical boss part mounted to a protruding end side, and a lengthy plate-shaped protective cover having one side in the direction supported by a cover guide provided to the tube in order to protect the rod, and having the other side mounted to the boss part. This protective cover suppresses collision of the earth and sand, stones and the like against the rod protruding from the tube during the excavating work and protects the rod from these earth and sand (Patent Documents 1 to 3).

PRIOR ART DOCUMENT

Patent Document

Patent Document 1: Japanese Patent Laid-Open No. 2006-16854 A

Patent Document 2: Japanese Utility Model Registration Laid-Open No. 5-12708 A

Patent Document 3: Japanese Patent Laid-Open No. 2007-107314 A

SUMMARY OF THE INVENTION

Incidentally, the cylinder device according to the aforementioned Patent Documents 1 to 3 can be used as a bucket cylinder device for rotating a bucket of a hydraulic excavator, for example. In this case, when the arm is folded and the boom is lowered in order to park the hydraulic excavator, there is a problem that the protective cover is brought into contact with the ground surface and the life of the protective cover is lowered. Moreover, each of the cylinder devices has a large number of components for mounting the protective cover, which leads to a problem that a cost is increased.

The present invention was made in view of the aforementioned prior-art problems and an object of the present invention is to provide a cylinder device which reduces the number of components of the protective cover and improves its life.

The present invention is comprising: a tube having a lengthy cylindrical shape in which one side in a length direction is closed as a bottom part, while the other side is a rod guide; a rod having one side mounted to a piston in the tube and the other side protruding capable of extension/contraction from the rod guide side and having a cylindrical boss part mounted to a protruding end side; and a lengthy plate-shaped protective cover having one side in the length direction supported by a cover guide provided to the tube in order to protect the rod, and having the other side mounted to the boss part, characterized in that: a protective protrusion protruding outward in a radial direction of the boss part and protecting the boss part and the protective cover is provided on the boss part; the protective cover is formed having a plate shape by a material having elasticity, and the protective cover is constituted by a plate part protecting the rod between the cover guide and the boss part and a winding part formed having an arc-shaped body so as to be wound around an outer periphery of the boss part from a distal end side of said plate part; and a protective protrusion engaging hole into which the protective protrusion is engaged is provided in the winding part at a position corresponding to the protective protrusion.

According to the present invention, the cost of the cylinder device including the protective cover can be reduced, and the life can be improved.

MODE FOR CARRYING OUT THE INVENTION

Figure 1:
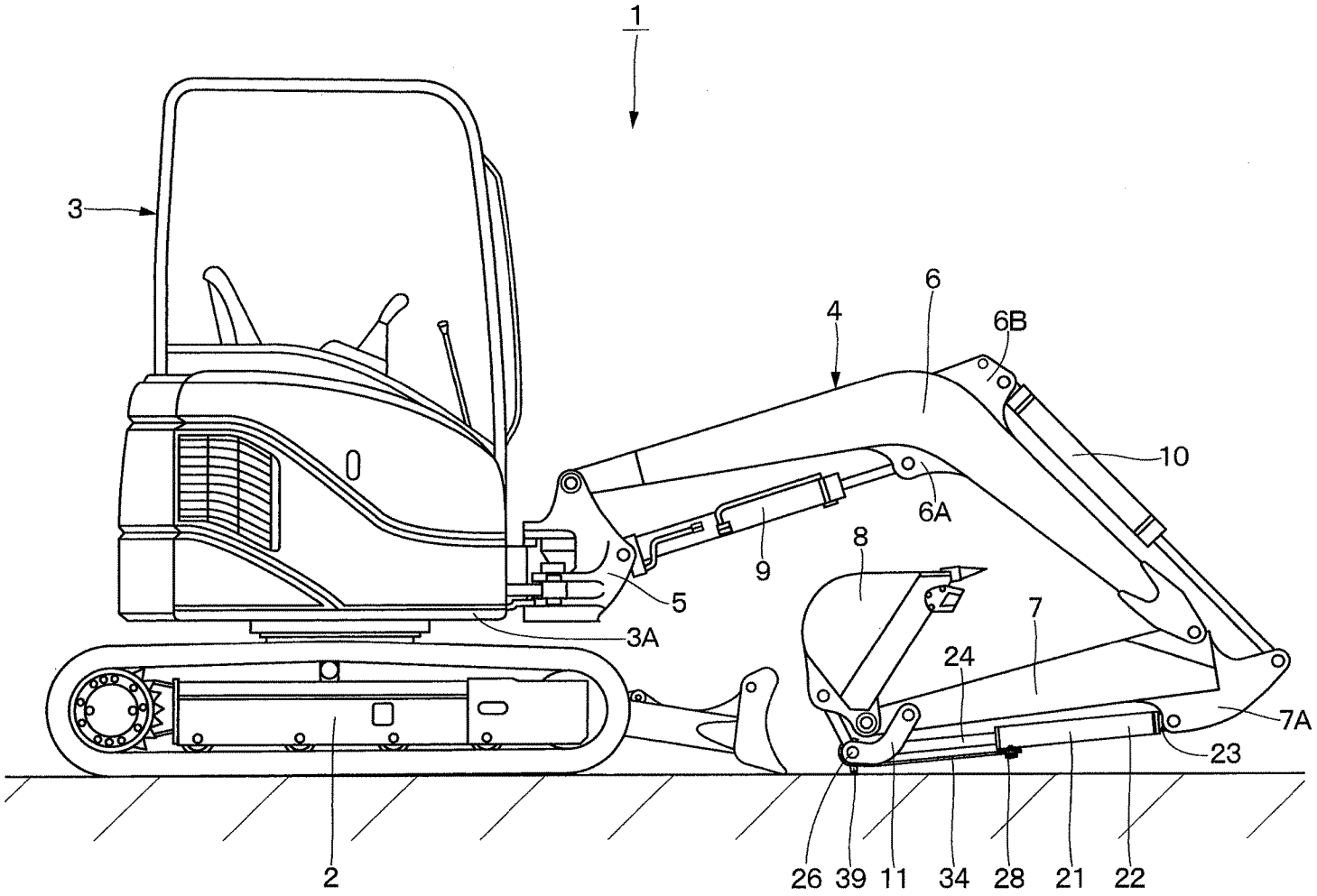
FIG. 1 is a front view showing a case where a cylinder device according to a first embodiment of the present invention is used as a bucket cylinder of a hydraulic excavator.

Hereinafter, a case in which a cylinder device according to the present invention is applied to a bucket cylinder of a hydraulic excavator will be explained as an example in detail.

FIGS. 1 to 6 show a first embodiment of a cylinder device according to the present invention.

The hydraulic excavator 1 is constituted by including an automotive crawler-type lower traveling structure 2, an upper revolving structure 3 rotatably mounted on the lower traveling structure 2, and a swing-type working mechanism 4 provided on a front part side of the upper revolving structure 3. The hydraulic excavator 1 is capable of performing an excavating work of earth and sand or the like by the working mechanism 4.

Here, the swing-type working mechanism 4 is constituted by including a swing post 5 mounted on a front end side of a revolving frame 3A which becomes a base of the upper revolving structure 3, swingably in a left-right direction, a boom 6 mounted on an upper end part of the swing post 5, rotatably in a vertical direction, an arm 7 mounted on a distal end side of the boom 6, rotatably in the vertical direction, and a bucket 8 mounted on a distal end side of the arm 7, rotatably in the vertical direction.

As shown in FIG. 1, a cylinder bracket 6A on which a rod of a boom cylinder 9 which will be described later is rotatably mounted is provided on a lower surface side of the boom 6. On the other hand, a cylinder bracket 6B on which a tube of an arm cylinder 10 which will be described later is rotatably mounted is provided on an upper surface side of the boom 6. In addition, a cylinder bracket 7A on which a rod of the arm cylinder 10 and a tube 22 of a bucket cylinder 21 which will be described later are rotatably mounted is provided on a base end part on the boom 6 side in the arm 7.

A boom cylinder 9 for rotatably driving the boom 6 is provided between the swing post 5 and the cylinder bracket 6A of the boom 6. Moreover, the arm cylinder 10 for rotatably driving the arm 7 is provided between the cylinder bracket 6A of the boom 6 and the cylinder bracket 7A of the arm 7. The bucket cylinder 21 which will be described later for rotating/driving the bucket 8 is provided between the cylinder bracket 7A of the arm 7 and a bucket link 11. The working mechanism 4 is to perform an excavating work of a gutter or the like in the road, for example, by rotating the boom 6, the arm 7, and the bucket 8 in a state where the swing post 5 is made to swing in the left-right direction by a swing cylinder (not shown).

Next, the bucket cylinder 21 will be described as a typical example of the cylinder device according to this embodiment.

The bucket cylinder 21 is provided between the arm 7 and the bucket link 11 and is to rotate the bucket 8 with respect to the arm 7. This bucket cylinder 21 constitutes the cylinder device of the present invention. The bucket cylinder 21 is constituted by including the tube 22, a piston (not shown), a rod 24, a cover guide 28, and a protective cover 34.

The tube 22 has one side in a length direction closed as a bottom part 22A, while the other side forms a lengthy cylindrical shape (cylindrical shape) as a rod guide 22B. A mounting eye (crevice) 23 is integrally provided on the bottom part 22A. As shown in FIG. 1, the mounting eye 23 is rotatably pin-connected to the cylinder bracket 7A of the arm 7. The piston (not shown) is slidably inserted into the tube 22 in an axial direction. One side of the rod 24 which will be described later is mounted on this piston.

Figure 6:
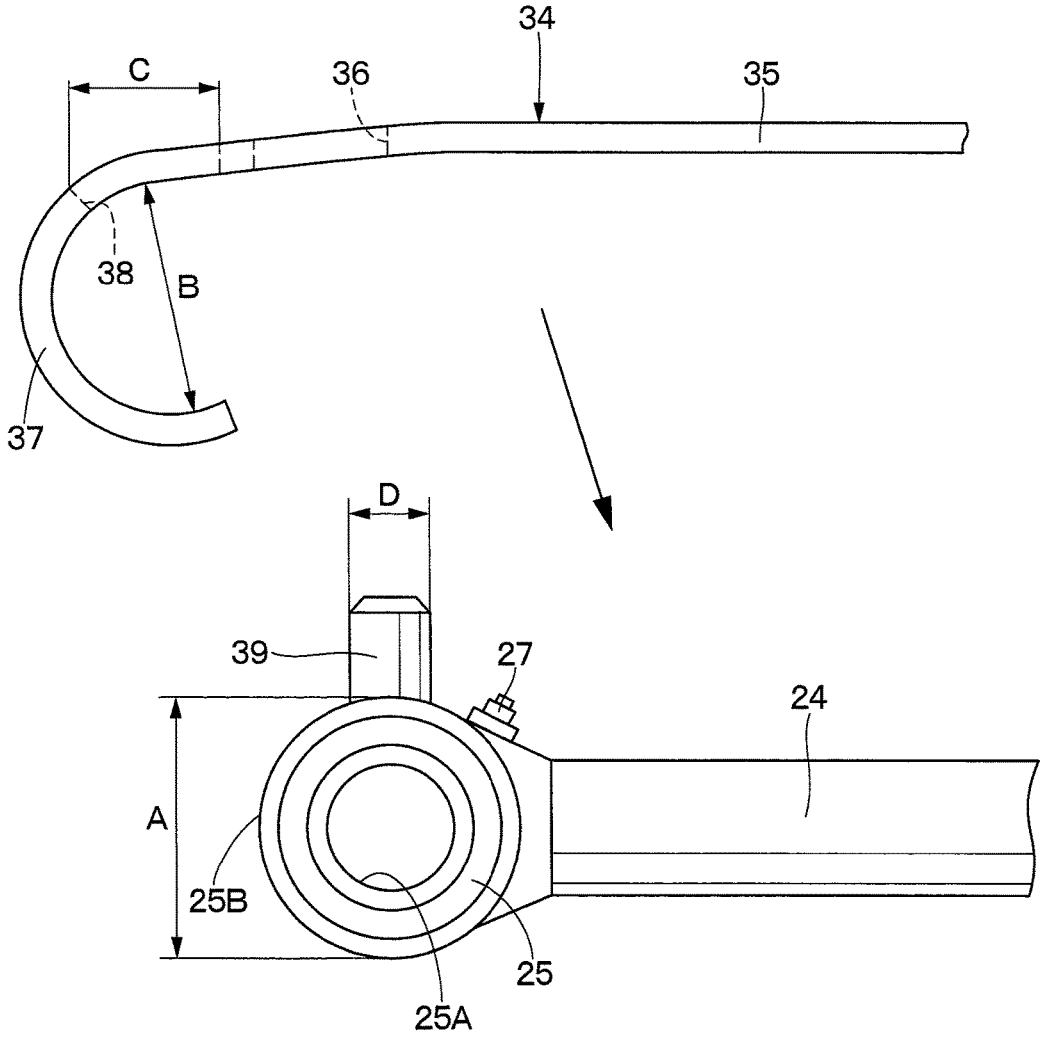
FIG. 6 is an enlarged exploded view of an essential part showing a winding part of the protective cover and a boss part of a rod in a free state.

The rod 24 has one side mounted to the piston in the tube 22, while the other side protrudes from the rod guide 22B side, capable of extension/contraction. As shown in FIG. 6, a cylindrical boss part 25 forming an outer diameter dimension A is mounted to a protruding end side of the rod 24. An inner circumferential side of the boss part 25 is a pin insertion hole 25A extending in an orthogonal direction to an axial direction (extension/contraction direction) of the rod 24. The rod 24 is pin-connected with the bucket link 11 by using a pin 26 inserted into the pin insertion hole 25A (see, FIG. 2).

On the other hand, a grease nipple 27 is provided on a distal end side of the rod 24 in an outer periphery 25B of the boss part 25. This grease nipple 27 protrudes outward in the radial direction of the boss part 25. The grease nipple 27 is mounted in a greasing hole (not shown) drilled toward the pin insertion hole 25A from the outer periphery 25B of the boss part 25. The grease nipple 27 is for supplying a lubricant oil such as a grease into the pin insertion hole 25A of the boss part 25.

Figure 2:
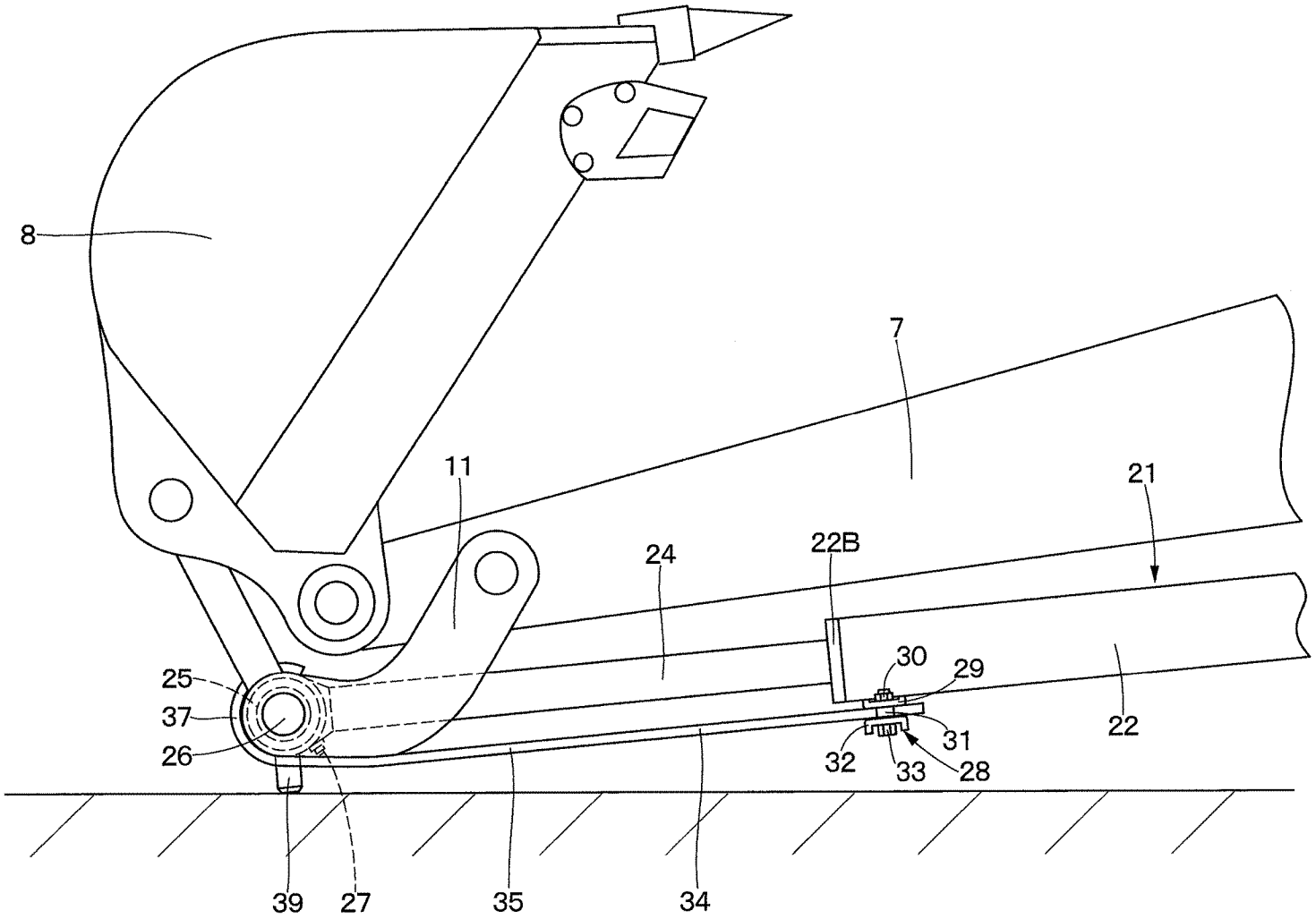
FIG. 2 is an enlarged front view of an essential part showing an arm, a bucket, a bucket cylinder and the like in FIG. 1.

As shown in FIG. 2, the grease nipple 27 protrudes outward in the radial direction of the boss part 25 at a position on a side opposite to the arm 7 in the outer periphery 25B of the boss part 25. Therefore, a grease gun, not shown, can be easily attached to the grease nipple 27, the lubricant oil can be supplied to the pin insertion hole 25A. Further, a protective protrusion 39 which will be described later is provided on the outer periphery 25B of the boss part 25. The grease nipple 27 and the protective protrusion 39 are juxtaposed and provided in the extension/contraction direction of the rod 24.

The cover guide 28 is provided on the rod guide 22B side in the tube 22. This cover guide 28 is fixed to the tube 22 by welding or the like at a position on the side opposite to the arm 7 in the outer periphery of the tube 22. The cover guide 28 is to support the protective cover 34 which will be described later movably in the extension/contraction direction of the rod 24 when the rod 24 is extended/contracted with respect to the tube 22. The cover guide 28 is constituted by including a support plate 29, a column 31, and a clamping plate 32.

The support plate 29 is a plate material having a substantially inverted U-shape extending in an orthogonal direction to the axial direction of the tube 22 and is fixed to the outer periphery of the tube 22 by welding or the like. The support plate 29 is fixed to the outer periphery of the tube 22 by welding or the like and is constituted by a pair of leg parts 29A extending outward in the radial direction of the tube 22 and a protective cover support part 29B connecting distal end sides of the leg parts 29A. Through holes (not shown) penetrated in a thickness direction are drilled in both end sides in a longitudinal direction of the protective cover support part 29B. back surface 29B1Nuts 30 (only one of them is shown) are fixed to a back surface 29B1 (surface on the tube 22 side) of the protective cover support part 29B by welding or the like at positions corresponding to the through holes, respectively. Moreover, columns 31 are fixed to a front surface 29B2 of the protective cover support part 29B by welding or the like at positions corresponding to the through holes, respectively.

Each of the columns 31 is formed as a cylindrical body in which a bolt insertion hole 31A is drilled in an inner circumferential side. A height dimension of each column 31 has a value larger than a thickness dimension of the protective cover 34 which will be described later. In addition, a dimension between each of the columns 31 has a value larger than a width dimension of the protective cover 34. As a result, it is constituted such that a plate part 35 of the protective cover 34 can be disposed between each of the columns 31.

The clamping plate 32 is a plate material having a substantial U-shape extending in the orthogonal direction to the axial direction of the tube 22 and is faced with the support plate 29 through the column 31. The clamping plate 32 supports the protective cover 34 which will be described later by clamping it with the support plate 29. Bolt through holes 32A are drilled at positions corresponding to the columns 31 in the clamping plate 32, respectively.

In a state where the plate part 35 of the protective cover 34 is disposed between each of the columns 31 on the protective cover support part 29B, a bolt 33 is inserted into the bolt through hole 32A of the clamping plate 32, the bolt insertion hole 31A of the column 31, and the through hole of the support plate 29 and screwed with the nut 30. As a result, the plate part 35 of the protective cover 34 is clamped with a slight gap between the support plate 29 and the clamping plate 32 and is supported movably in the extension/contraction direction of the rod 24.

Subsequently, the protective cover 34 for protecting the rod 24 of the bucket cylinder 21 will be described.

That is, the protective cover 34 has one side in the length direction supported by the cover guide 28 provided on the tube 22, and has the other side mounted on the boss part 25. This protective cover 34 is formed having a lengthy plate shape extending from the tube 22 to the boss part 25. As shown in FIG. 2, the protective cover 34 is disposed on the side opposite to the arm 7 across the rod 24 in order to protect the rod 24 from earth and sand and the like. That is, the rod 24 is constituted to be located between the arm 7 and the protective cover 34.

The protective cover 34 is formed by a resin material having elasticity or a steel plate material having elasticity so as to be able to stand contact with the earth and sand, stones and the like. As the resin material, nylon, polycarbonate, ASA resin and the like with strong impact resistance are suitably used, for example. As the steel plate material, a spring steel such as a carbon steel, a silicon manganese steel and the like is suitably used, for example. The protective cover 34 is constituted by a plate part 35 and a winding part 37.

The plate part 35 is formed having a lengthy plate shape extending from the cover guide 28 toward the boss part 25. That is, the plate part 35 protects the rod 24 between the cover guide 28 and the boss part 25. The plate part 35 is clamped between the support plate 29 of the cover guide 28 and the clamping plate 32 and is supported movably in the extension/contraction direction of the rod 24. That is, the plate part 35 is retained by the cover guide 28 and slides/moves between the support plate 29 of the cover guide 28 and the clamping plate 32 by following the extension/contraction operation of the rod 24.

The plate part 35 is formed by a resin material or a steel plate material having elasticity. Therefore, the plate part 35 is elastically deformed (flexural deformation) into a recess shape toward the rod 24 side when being brought into contact with earth and sand. As a result, the plate part 35 relaxes an external force by contact with the earth and sand and suppresses the deformation.

A nipple through hole 36 penetrated in the thickness direction is formed on a distal end side of the plate part 35. This nipple through hole 36 is formed at a position corresponding to the grease nipple 27 provided on the boss part 25 and becomes an opening when a nozzle of the grease gun, not shown, is attached to the grease nipple 27. Moreover, the nipple through hole 36 is constituted such that the grease nipple 27 is inserted therein when the earth and sand or the like are brought into contact with the plate part 35, and the plate part 35 is deflected toward the rod 24. As a result, the grease nipple 27 is not brought into contact with the plate part 35 even if the plate part 35 is deflected and thus, the lives of the grease nipple 27 and the plate part 35 can be improved.

The winding part 37 is formed as an arc-shaped body so as to be wound around the outer periphery 25B of the boss part 25 from the distal end side of the plate part 35. As shown in FIG. 6, an arc diameter B of the winding part 37 is formed smaller than an outer diameter dimension A of the boss part 25 in a free state (state removed from the boss part 25). The winding part 37 is held by having elasticity toward an inner side in the radial direction of the boss part 25 in a state wound around the boss part 25. That is, the winding part 37 is held by the boss part 25 by being fitted in the outer periphery 25B of the boss part 25. Therefore, in the protective cover 34, one side of the plate part 35 in a length direction is supported by the cover guide 28 movably in the extension/contraction direction of the rod 24, while the other side of the plate part 35 is held by the winding part 37 elastically wound around the outer periphery 25B of the boss part 25.

A protective protrusion engaging hole 38 is penetrated in the thickness direction of the winding part 37 at a position corresponding to the protective protrusion 39 which will be described later provided on the boss part 25. This protective protrusion engaging hole 38 is formed by being juxtaposed with the nipple through hole 36 in the extension/contraction direction of the rod 24. The protective protrusion engaging hole 38 is formed movably with respect to the protective protrusion 39 by elastic deformation of the protective cover 34.

Figure 3:
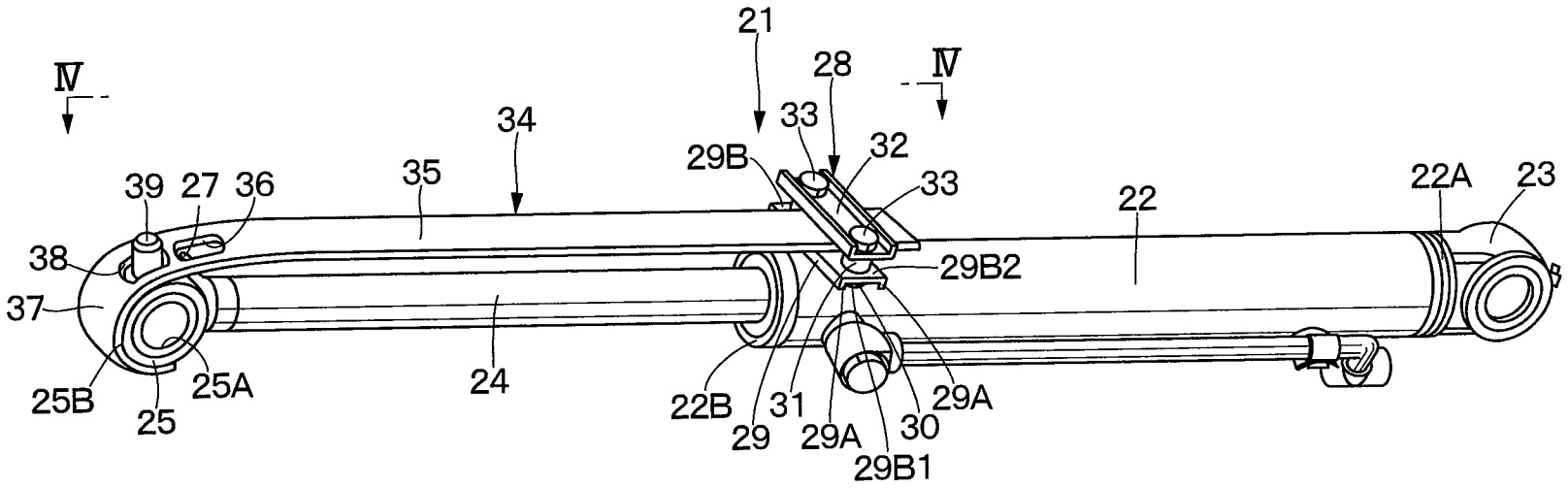
FIG. 3 is a perspective view showing the bucket cylinder as a single body.
Figure 4:
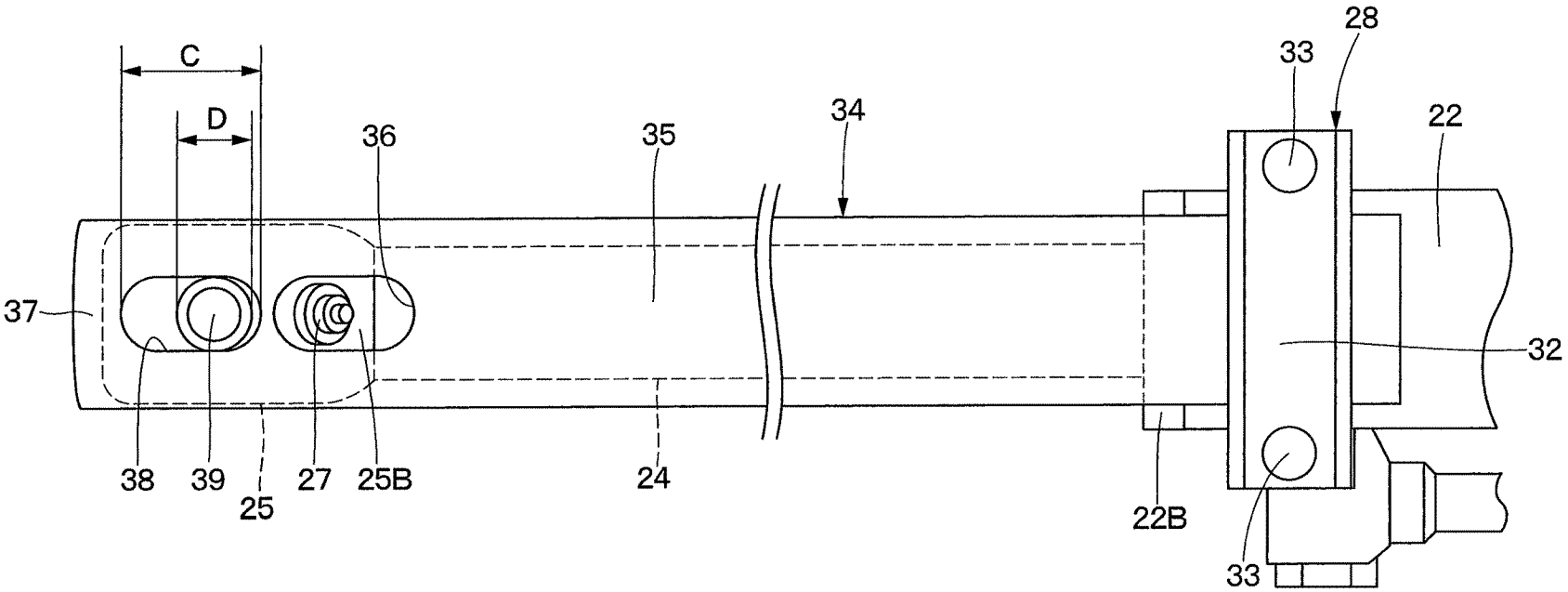
FIG. 4 is an enlarged plan view of an essential part of the bucket cylinder when seen from an arrow IV-IV direction in FIG. 3.
Figure 5:
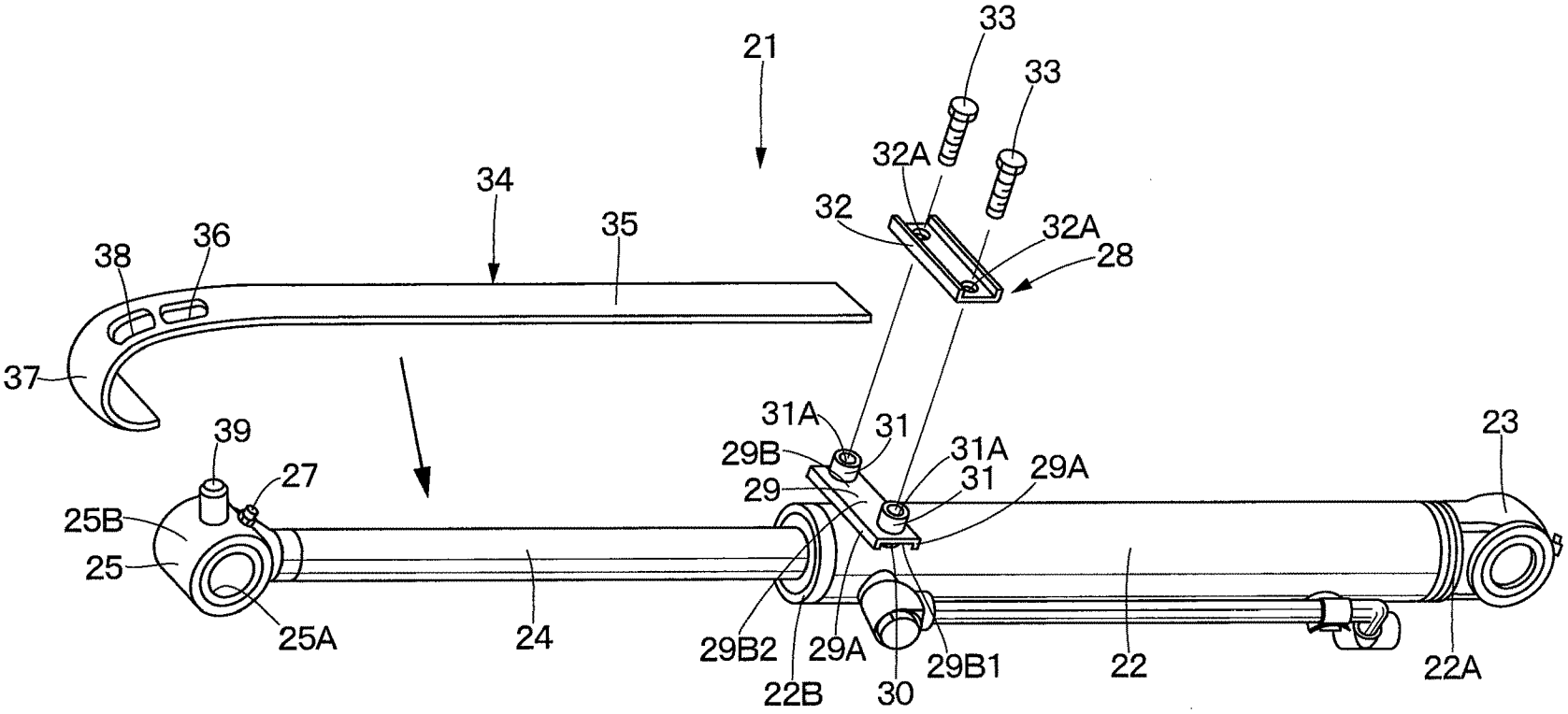
FIG. 5 is an exploded perspective view showing a tube, a rod, a cover guide, and a protective cover.

Specifically, the protective protrusion engaging hole 38 is formed as a long hole extending in a circumferential direction of the winding part 37. As shown in FIGS. 4 and 6, a length dimension C of the protective protrusion engaging hole 38 is formed larger than an outer diameter dimension D of the protective protrusion 39. As shown in FIGS. 3 and 4, in a state where the winding part 37 is fitted in the boss part 25, the protective protrusion 39 is located on the base end side (nipple through hole 36 side) of the protective protrusion engaging hole 38.

In this case, when the earth and sand or the like are brought into contact with the plate part 35 of the protective cover 34, the plate part 35 is elastically deformed (flexural deformation) into a recess shape toward the rod 24 side. The winding part 37 is pulled by the deformation and is slidably displaced on the outer periphery 25B of the boss part 25 in the circumferential direction. With that, the protective protrusion engaging hole 38 moves to a contraction side in the extension/contraction direction of the rod 24 with respect to the protective protrusion 39. As a result, since concentration of a load to the winding part 37 and the protective protrusion 39 can be suppressed, the life of the protective cover 34 can be improved.

The protective protrusion 39 is fixed to the outer periphery 25B of the boss part 25 by welding or the like at a position different from the grease nipple 27. This protective protrusion 39 is juxtaposed with the grease nipple 27 in the extension/contraction direction of the rod 24 and is provided on the boss part 25. The protective protrusion 39 is formed having a solid columnar body, for example, and protrudes outward in the radial direction of the boss part 25 and protects the boss part 25 and the protective cover 34.

As shown in FIGS. 1 and 2, the protective protrusion 39 is located on the side opposite to the arm 7 across the rod 24 in the outer periphery 25B of the boss part 25 and protrudes outward in the radial direction of the boss part 25. Moreover, the protective protrusion 39 penetrates the protective protrusion engaging hole 38 of the protective cover 34 and protrudes outward from the plate part 35 of the protective cover 34.

When the bucket 8 of the working mechanism 4 is brought closer to the ground surface, the tube 22 and the rod 24 of the bucket cylinder 21 is brought closer to the ground surface. In this case, the protective protrusion 39 is brought into contact with the ground surface, whereby the protective cover 34 can be a state not in contact with the ground surface. Specifically, when the arm 7 of the hydraulic excavator 1 is folded and the boom 6 is lowered in order to obtain a parking state of the hydraulic excavator 1 as shown in FIG. 1, the protective protrusion 39 is first brought into contact with the ground surface. Therefore, the protective cover 34 is in the non-contact state with the ground surface. That is, the protective protrusion 39 is provided on the outer periphery 25B of the boss part 25 so that the protective cover 34 can be the non-contact state with the ground surface when the arm 7 of the hydraulic excavator 1 is folded and the boom 6 is lowered.

It should be noted that when the protective cover 34 is not mounted, for example, the protective protrusion 39 is brought into contact with the ground surface, whereby the boss part 25 can be the non-contact state with the ground surface. Therefore, the protective protrusion 39 improves the lives of the boss part 25 and the protective cover 34 by bringing the boss part 25 and the protective cover 34 into the non-contact state with the ground surface.

The bucket cylinder according to the first embodiment has the constitution as described above, and the hydraulic excavator 1 including this bucket cylinder can perform the excavating work of a gutter or the like in a road by causing the swing post 5 to swing in the left-right direction by the swing cylinder (not shown) and by rotating the boom 6, the arm 7, and the bucket 8 by the boom cylinder 9, the arm cylinder 10, and the bucket cylinder 21, respectively, for example.

In this excavating work, when the rod 24 of the bucket cylinder 21 is extended/contracted with respect to the tube 22, the protective cover 34 moves by following the rod 24 while being guided by the cover guide 28. As a result, the protective cover 34 protects the rod 24 protruding from the rod guide 22B of the tube 22 at all times from the outer periphery side and thus, contact of the rod 24 protruding from the tube 22 with the earth and sand or stones or the like can be prevented.

Incidentally, the cylinder device described in the aforementioned Patent Document 1 to Patent Document 3 can be used as a bucket cylinder device for rotating the bucket of the hydraulic excavator, for example. In this case, when the hydraulic excavator is parked or the hydraulic excavator is transported or the like, if the arm is folded and the boom is lowered, it leads to a problem that the protective cover is brought into contact with the ground surface and a rear deck of a trailer, which lowers the life of the protective cover.

Moreover, in the cylinder device described in the aforementioned Patent Document 1 and Patent Document 2, the protective cover is formed of an elastic material in order to suppress deformation of the protective cover when earth and sand are brought into contact with the protective cover. However, since the support part of the protective cover has complicated constitution in order not to concentrate the load when the protective cover is elastically deformed and has a large number of components, which leads to a problem of a cost increase.

Thus, the cylinder device (bucket cylinder 21) according to the first embodiment has the protective protrusion 39 provided by protruding outward in the radial direction of the boss part 25 on the boss part 25 of the rod 24. This protective protrusion 39 penetrates the protective protrusion engaging hole 38 of the protective cover 34 and protrudes outward from the plate part 35 of the protective cover 34. Therefore, when the bucket 8 of the working mechanism 4 is brought closer to the ground surface, and the tube 22 and the rod 24 of the bucket cylinder 21 are brought closer to the ground surface, the protective protrusion 39 is brought into contact with the ground surface, whereby the protective cover 34 and the ground surface can be the non-contact state.

Specifically, as shown in FIGS. 1 and 2, when the arm 7 of the hydraulic excavator 1 is folded and the boom 6 is lowered, the protective protrusion 39 is first brought into contact with the ground surface, and the protective cover 34 can be the non-contact state with the ground surface. As a result, since the protective cover 34 is protected by the protective protrusion 39, the life can be improved.

In addition, the protective protrusion 39 is provided at a position different from the grease nipple 27 in the outer periphery 25B of the boss part 25. As a result, since contact of the grease nipple 27 with the earth and sand can be suppressed, the life of the grease nipple 27 can be improved.

Moreover, the protective cover 34 is formed by a material having elasticity. Furthermore, the protective cover 34 is constituted by the plate part 35 extending from the cover guide 28 toward the boss part 25 and the winding part 37 formed as the arc-shaped body so as to be wound around the outer periphery of the boss part 25 from the distal end side of the plate part 35. As shown in FIG. 6, the arc diameter B of the winding part 37 is formed smaller than the outer diameter dimension A of the boss part 25 in the free state.

The winding part 37 is held by having elasticity toward the inner side in the radial direction of the boss part 25 in a state wound around the boss part 25. That is, the winding part 37 of the protective cover 34 is held by the boss part 25 by being fitted in the outer periphery 25B of the boss part 25. In addition, the plate part 35 is supported by the cover guide 28 movably in the extension/contraction direction of the rod 24. As a result, since the protective cover 34 is mounted on the tube 22 and the rod 24 with a smaller number of components, the cost can be reduced.

Moreover, the protective protrusion engaging hole 38 formed in the protective cover 34 is formed as a long hole extending in the circumferential direction of the winding part 37. That is, the length dimension C of the protective protrusion engaging hole 38 is a dimension larger than the outer diameter dimension D of the protective protrusion 39. In the state where the winding part 37 is fitted in the boss part 25, it is constituted such that the protective protrusion 39 is located on the base end side (nipple through hole 36 side) of the protective protrusion engaging hole 38.

In this case, when earth and sand or the like are brought into contact with the plate part 35 of the protective cover 34, the plate part 35 is elastically deformed (flexural deformation) to a recess shape toward the rod 24 side. The winding part 37 is pulled by the deformation and is slidably displaced on the outer periphery 25B of the boss part 25 in the circumferential direction. With that, the protective protrusion engaging hole 38 moves to the contraction side in the extension/contraction direction of the rod 24 with respect to the protective protrusion 39. As a result, since concentration of a load to the winding part 37 and the protective protrusion 39 can be suppressed, the life of the protective cover 34 can be improved. That is, since the protective cover 34 can make the winding part 37 rotatable even with the smaller number of components and can suppress concentration of the load by elastic deformation of the plate part 35, the cost can be reduced.

Figure 7:
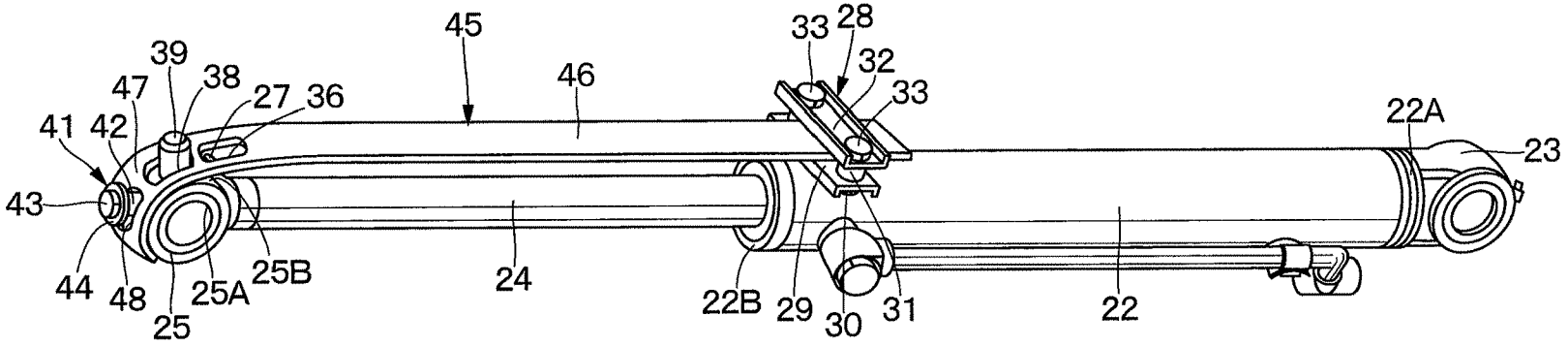
FIG. 7 is a perspective view showing the cylinder device according to a second embodiment of the present invention as a single body.
Figure 8:
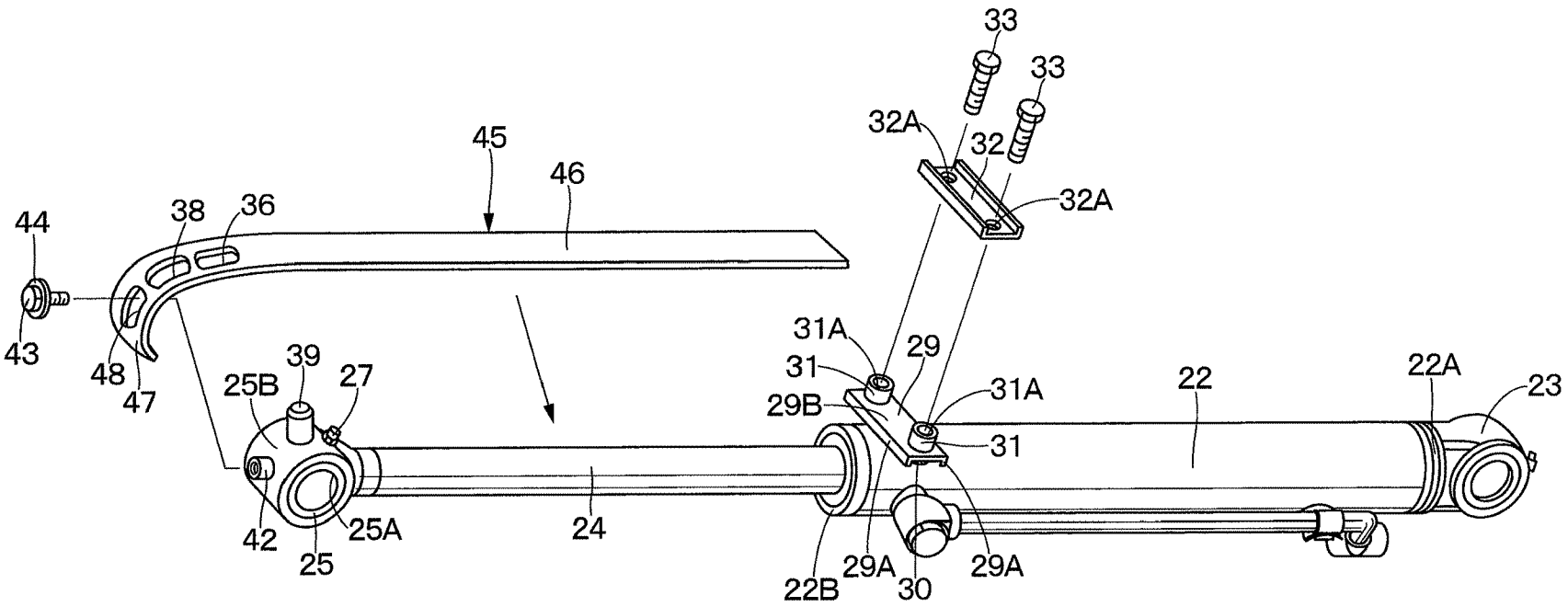
FIG. 8 is an exploded perspective view showing the tube, the rod, the cover guide, and the protective cover.

Next, FIGS. 7 and 8 show a second embodiment of the present invention. A feature of this embodiment is that a retaining member for retaining the winding part is provided on the boss part. In this embodiment, the same constituent elements as those in the first embodiment are given the same reference numerals, and the description thereof will be omitted.

A retaining member 41 is provided at a position different from the protective protrusion 39 in the outer periphery 25B of the boss part 25. This retaining member 41 is fixed to the outer periphery 25B of the boss part 25 by welding or the like and retains a winding part 47 which will be described later by protruding outward in the radial direction of the boss part 25. The retaining member 41 is constituted by a screw seat 42, a bolt 43, and a washer 44.

As shown in FIGS. 7 and 8, the screw seat 42 is located in the extension/contraction direction of the rod 24 in the outer periphery 25B of the boss part 25 and protrudes outward in the radial direction of the boss part 25. In other words, the screw seat 42 protrudes toward an extension side in the extension/contraction direction of the rod 24 from the outer periphery 25B of the boss part 25. A protective cover 45 is retained by clamping the winding part 47 between the washer 44 and the screw seat 42 by inserting the bolt 43 on which the washer 44 is mounted into a retaining member engaging hole 48, which will be described later, and by screwing the bolt 43 in the screw seat 42.

In this case, since the retaining member 41 is located in the extension/contraction direction of the rod 24 and protrudes outward in the radial direction of the boss part 25, the retaining member 41 does not protrude outward from a plate part 46 which will be described later. Therefore, with respect to the retaining member 41, the bolt 43 or the like can be the non-contact state with the ground surface when the arm 7 of the hydraulic excavator 1 is folded and the boom 6 is lowered, for example, stability and a life of the retaining member 41 can be improved.

The protective cover 45 is formed by a resin material having elasticity or a steel plate material having elasticity similarly to the first embodiment. As the resin material, nylon, polycarbonate, ASA resin and the like with strong impact resistance are suitably used, for example. As the steel plate material, a spring steel such as a carbon steel, a silicon manganese steel and the like is suitably used, for example. The protective cover 45 is constituted by the plate part 46 and the winding part 47. The plate part 46 is formed having a lengthy plate shape extending from the cover guide 28 toward the boss part 25. That is, the plate part 46 protects the rod 24 between the cover guide 28 and the boss part 25. On the other hand, the winding part 47 is formed as an arc-shaped body so as to be wound around the outer periphery 25B of the boss part 25 from a distal end side of the plate part 46.

The winding part 47 may be held by having elasticity toward an inner side in the radial direction of the boss part 25 similarly to the winding part 37 according to the first embodiment. However, since the winding part 47 is retained by the retaining member 41 with respect to the boss part 25, the winding part 47 does not have to have elasticity toward the inner side in the radial direction of the boss part 25.

The retaining member engaging hole 48 is formed by being juxtaposed with the protective protrusion engaging hole 38 in the circumferential direction of the winding part 47. This retaining member engaging hole 48 penetrates in the thickness direction of the winding part 47 at a position corresponding to the retaining member 41 provided on the boss part 25. The retaining member engaging hole 48 is formed movably with respect to the retaining member 41 by elastic deformation of the protective cover 45.

Specifically, the retaining member engaging hole 48 is formed as a long hole extending in the circumferential direction of the winding part 47. In the state where the winding part 47 is fitted in the boss part 25, the retaining member 41 is located on a base end side (protective protrusion engaging hole 38 side) of the retaining member engaging hole 48. In this case, when earth and sand or the like are brought into contact with the plate part 46 of the protective cover 45, the plate part 46 is elastically deformed (flexural deformation) into a recess shape toward the rod 24 side. The winding part 47 is pulled by the deformation and is slidably displaced on the outer periphery 25B of the boss part 25 in the circumferential direction. With that, the retaining member engaging hole 48 moves in the circumferential direction of the boss part 25 with respect to the retaining member 41. As a result, since concentration of a load to the winding part 47 and the retaining member 41 can be suppressed, the life of the protective cover 45 can be improved.

Thus, in the second embodiment constituted as above, too, actions and effects similar to those in the aforementioned first embodiment can be obtained. Particularly, in the second embodiment, the winding part 47 is held by having elasticity toward the inner side in the radial direction of the boss part 25, and the retaining member 41 retains the winding part 47. As a result, the protective cover 45 can further improve stability. In addition, the retaining member 41 is located in the extension/contraction direction of the rod 24 and protrudes outward in the radial direction of the boss part 25. As a result, when the arm 7 of the hydraulic excavator 1 is folded and the boom 6 is lowered, for example, the protective protrusion 39 is brought into contact with the ground surface at first, and the bolt 43 and the like can be the non-contact state with the ground surface. Therefore, stability and the life of the retaining member 41 can be improved.

It should be noted that in the aforementioned first embodiment, the case where the protective protrusion 39 is a columnar body is described as an example. However, the present invention is not limited to that but the protective projection may be formed by a square columnar body, for example. The same applies to the second embodiment.

Further, in the aforementioned first embodiment, the case where the protective protrusion engaging hole 38 is formed as a long hole extending in the circumferential direction of the winding part 37 is described as an example. However, the present invention is not limited to that, and the protective protrusion engaging hole may be a circular hole having a hole diameter larger than the outer diameter dimension of the protective protrusion. The same applies to the second embodiment.

Further, in the aforementioned second embodiment, the case where the retaining member 41 is constituted by the screw seat 42, the bolt 43, and the washer 44 is described as an example. However, the present invention is not limited to that, and the winding part may be retained by hitting a pin including a washer into a cylinder part having a pin hole, for example.

Furthermore, in each of the aforementioned embodiments, the case where the cylinder device is applied to the bucket cylinder 21 of the hydraulic excavator 1 is described as an example. However, the present invention is not limited to that but the cylinder device may be applied to the boom cylinder 9 or the arm cylinder 10 of the hydraulic excavator 1, for example, or not limited to the hydraulic excavator 1, it can be widely applied to cylinder devices mounted on other construction machines such as a hydraulic crane or the like or other work machines, for example.

DESCRIPTION OF REFERENCE NUMERALS

21: Bucket cylinder (cylinder device)
22: Tube
22A: Bottom part
22B: Rod guide
24: Rod
25: Boss part
28: Cover guide
34, 45: Protective cover
35, 46: Plate part
37, 47: Winding part
38: protective protrusion engaging hole
39: protective protrusion
41: Retaining member
48: Retaining member engaging hole
A: Outer diameter dimension of boss part
B: Arc diameter of winding part

The invention claimed is:

1. A construction machine comprising:

an automotive lower traveling structure;

an upper revolving structure rotatably mounted on said lower traveling structure;

a working mechanism, mounted on a front part side of said upper revolving structure, capable of moving upward/downward, wherein said working mechanism includes a boom provided on said upper revolving structure, capable of moving upward/downward, an arm provided rotatably on a distal end side of said boom, and a bucket provided rotatably on a distal end side of said arm, a bucket cylinder for rotating said bucket is provided between said arm and said bucket, and said bucket cylinder includes a tube having a lengthy cylindrical shape in which one side in a length direction of said tube is closed as a bottom part, while the other side in the length direction of said tube is a rod guide;

a rod having one side mounted to a piston in said tube and the other side protruding capable of extension/contraction from said rod guide side and having a cylindrical boss part mounted to a protruding end side;

a lengthy plate-shaped protective cover having one side in a length direction of said protective cover supported by a cover guide provided to said tube in order to protect said rod, while the other side in the length direction of said protective cover is mounted to said boss part, wherein said protective cover is constituted by a plate part protecting said rod between said cover guide and said boss part and a winding part formed having an arc-shaped body so as to be wound around an outer periphery of said boss part from a distal end side of said plate part and formed by a material having elasticity;

a protective protrusion protruding outward in a radial direction of said boss part provided on an outer periphery of said boss part, a protective protrusion engaging hole into which said protective protrusion is engaged being provided in said winding part at a position corresponding to said protective protrusion;

a retaining member protruding toward an outer side in a radial direction of said boss part at a position different from said protective protrusion and retaining said winding part provided on said boss part; and a retaining member engaging hole into which said retaining member is engaged provided in said winding part at a position corresponding to said retaining member, wherein when said tube and said rod of said bucket cylinder are brought closer to a ground surface by bringing said bucket of said working mechanism closer to the ground surface, said protective protrusion is arranged to penetrate through said protective protrusion engaging hole of said protective cover and protrude outward from said protective cover, so as to bring said protective protrusion into contact with the ground surface.

2. The construction machine according to claim 1, wherein an arc diameter of said winding part is formed smaller than an outer diameter dimension of said boss part in a free state, and said winding part is held having elasticity toward an inner side in a radial direction of said boss part in a state wound around said boss part.

3. The construction machine according to claim 1, wherein said protective protrusion engaging hole is formed movably with respect to said protective protrusion by elastic deformation of said protective cover.

4. The construction machine according to claim 1, wherein said retaining member engaging hole is formed movably with respect to said retaining member by elastic deformation of said protective cover.

* * * * *